US007953352B2

(12) United States Patent
Dobbertin et al.

(10) Patent No.: US 7,953,352 B2
(45) Date of Patent: May 31, 2011

(54) MOVABLE METERING SKIVE FOR A DEVELOPMENT STATION OF A REPRODUCTION APPARATUS

(75) Inventors: Michael T. Dobbertin, Honeoye, NY (US); Wayne E. Sliger, Iowa City, IA (US); Donald S. Hensel, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 409 days.

(21) Appl. No.: 12/118,903

(22) Filed: May 12, 2008

(65) Prior Publication Data

US 2008/0273900 A1 Nov. 6, 2008

Related U.S. Application Data

(63) Continuation-in-part of application No. 11/512,926, filed on Aug. 30, 2006, now Pat. No. 7,502,581.

(51) Int. Cl.
*G03G 15/09* (2006.01)

(52) U.S. Cl. ..... 399/274

(58) Field of Classification Search ..... 399/267, 399/274–276, 284
See application file for complete search history.

(56) References Cited

U.S. PATENT DOCUMENTS 4,624,545 A * 11/1986 Yasuda et al. ..... 399/274
6,385,415 B1 5/2002 Hilbert et al.

* cited by examiner

*Primary Examiner* — Hoang Ngo
(74) *Attorney, Agent, or Firm* — Donna P. Suchy

(57) ABSTRACT

A magnetic brush development station for a reproduction apparatus has a housing forming, at least in part, a reservoir for developer material; a developer roller mounted within the housing for delivering developer material to a dielectric support member in a development zone; a transport mechanism for transporting developer material from the reservoir to the developer roller; a metering skive for establishing a developer material metering gap; and a mechanism for selectively moving the metering skive to an operative position relative to the developer roller and to a position remote from the developer roller, wherein a build up of contamination at the metering gap between the metering skive and the developer roller can be substantially prevented. A method of removing a skive blockage from a metering skive in a magnetic brush developer station is also disclosed.

13 Claims, 14 Drawing Sheets

MOVABLE METERING SKIVE FOR A DEVELOPMENT STATION OF A REPRODUCTION APPARATUS

CROSS REFERENCE TO RELATED APPLICATIONS

This application is a continuation-in-part of U.S. patent application Ser. No. 11/512,926 entitled "MOVEABLE METERING SKIVE FOR A DEVELOPMENT STATION OF A REPRODUCTION APPARATUS" and filed on Aug. 30, 2006 now U.S. Pat. No. 7,502,581. This application claims priority to U.S. patent application Ser. No. 11/512,926 for all subject matter which was disclosed in the Ser. No. 11/512,926 application.

FIELD OF THE INVENTION

This invention relates in general to a development station for a reproduction apparatus, and more particularly to a movable metering skive for a reproduction apparatus magnetic brush development station, for contamination control at such metering skive.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought directly, or indirectly via an intermediate transfer member, into contact with the dielectric support member, and an electric field is applied to transfer the marking particle developed image to the receiver member from the dielectric support member. After transfer, the receiver member bearing the transferred image is transported away from the dielectric support member, and the image is fixed (fused) to the receiver member by heat and/or pressure to form a permanent reproduction thereon.

One type of development station commonly utilized in electrographic reproduction apparatus is the magnetic brush development station, such as shown in U.S. Pat. No. 6,385,415, issued on May 7, 2002, in the names of Hilbert et al. The magnetic brush development station includes a housing providing a reservoir for a supply of developer material. The developer material may be, for example, two-component material including magnetic carrier particles and relatively smaller pigmented marking particles. A mechanism, such as a paddle wheel, auger, or ribbon blender, is located in the reservoir and serves to stir the carrier particles and marking particles to triboelectrically charge the particles so that the marking particles adhere to the surface of the carrier particles. A transport mechanism brings the developer material into the field of a plurality of magnets within a sleeve (commonly referred to as a developer or toning roller). The plurality of magnets and the sleeve are caused to rotate relative to one another such that the magnetic field of the magnets causes the marking particles to be brought into the vicinity of the latent image charge patterns on the dielectric support member. The marking particles are thus applied to the latent image charge patterns in order to adhere to, and thereby develop such patterns.

While magnetic brush development stations of the above-described type are generally suitable for operation in present commercial reproduction apparatus, improvements in speed and range of use escalate the demands on all of the systems of the reproduction apparatus, especially the development station. For example, reliability of the magnetic brush developer station can be affected when marking particles contaminate drive components, seals, and circuit boards. Increased customer and/or service personnel time to clean these components reduces the available up-time and productivity of the equipment. Contaminates are especially disturbing to the magnetic brush developer station performance at the point where developer material is metered onto the developer roller. Metering is necessary to provide a layer of developer material of only that thickness which will serve to optimally develop the image charge pattern on the dielectric support member. Any developer material flow disturbances lead to image quality artifacts in the finished permanent reproduction. Contaminants tend to collect on the metering skive, particularly when the contaminants are larger than the skive spacing from the developer roller. Collected contaminants then impede uniform flow of developer material to the developing zone into association with the dielectric support member, and generate the noted artifacts by, for example, causing incomplete image development. It is therefore desirable to prevent build up of contaminates at the metering skive.

SUMMARY OF THE INVENTION

In view of the above, the claimed invention is directed to a magnetic brush development station for a reproduction apparatus. The development station has a housing forming, at least in part, a reservoir for developer material. The development station also has a developer roller mounted within the housing for delivering developer material to a reproduction apparatus dielectric support member in a development zone, the developer roller including a core magnet inside a shell, the core magnet and the shell having relative rotation. The developer station further has a transport mechanism for transporting developer material from the reservoir to the developer roller. The developer station also has a metering skive for establishing a developer material metering gap between the metering skive and the developer roller for controlling the quantity of developer material transported from the reservoir portion of the housing to the developer roller and then through the development zone to develop a latent image charge pattern on the dielectric support member. The developer station also has a mechanism for selectively moving the metering skive to an operative position relative to the developer roller and to a position remote from the developer roller, wherein a build up of contamination at the metering gap between the metering skive and the developer roller can be substantially prevented.

The claimed invention is also directed towards a method of removing a skive blockage from a metering skive in a magnetic brush developer station. A skive movement mechanism is activated. A thumbwheel coupled to a developer roller of the developer station is rotated until the skive blockage appears on the toning shell of the developer roller. The skive blockage is removed.

The claimed invention is further directed towards another magnetic brush development station for a reproduction apparatus. The development station comprises: a) a housing forming, at least in part, a reservoir for developer material; b) a developer roller mounted within the housing for delivering developer material to a reproduction apparatus dielectric support member in a development zone, the developer roller including a core magnet inside a shell, the core magnet and the shell having relative rotation; c) a transport mechanism for transporting developer material from the reservoir to the developer roller; d) a metering skive for establishing a developer material metering gap between the metering skive and the developer roller for controlling the quantity of developer material transported from the reservoir portion of the housing to the developer roller and then through the development zone to develop a latent image charge pattern on the dielectric support member; e) a mechanism for selectively moving the metering skive to an operative position relative to the developer roller and to a position remote from the developer roller, wherein a build up of contamination at the metering gap between the metering skive and the developer roller can be substantially prevented; f) wherein the mechanism for selectively moving the metering skive comprises a side plate slideably coupled to the metering skive; g) wherein the side plate comprises one or more guide pins which slideably engage corresponding one or more bores defined by the metering skive; h) one or more spring elements positioned to bias the metering skive away from the side plate; i) one or more adjustment screws configured to limit a slideable range of motion of the metering skive away from the side plate; j) a pivot plate defining at least one slot; k) at least one skive frame element coupled to the housing and configured to pivotally support the pivot plate; l) at least one activation screw coupled to the metering skive through the at least one slot; m) at least one pivot guide coupled to the at least one skive frame element to support the pivot plate; n) wherein the pivot plate farther comprises a pivot axle; o) an actuator coupled to the pivot plate for rotating the pivot plate about a pivot axis; and p) a thumbwheel coupled to the developer roll and configured to enable manual rotation of the developer roll.

The invention, and its objects and advantages, will become more apparent in the detailed description of the preferred embodiment presented below.

Figure 1:
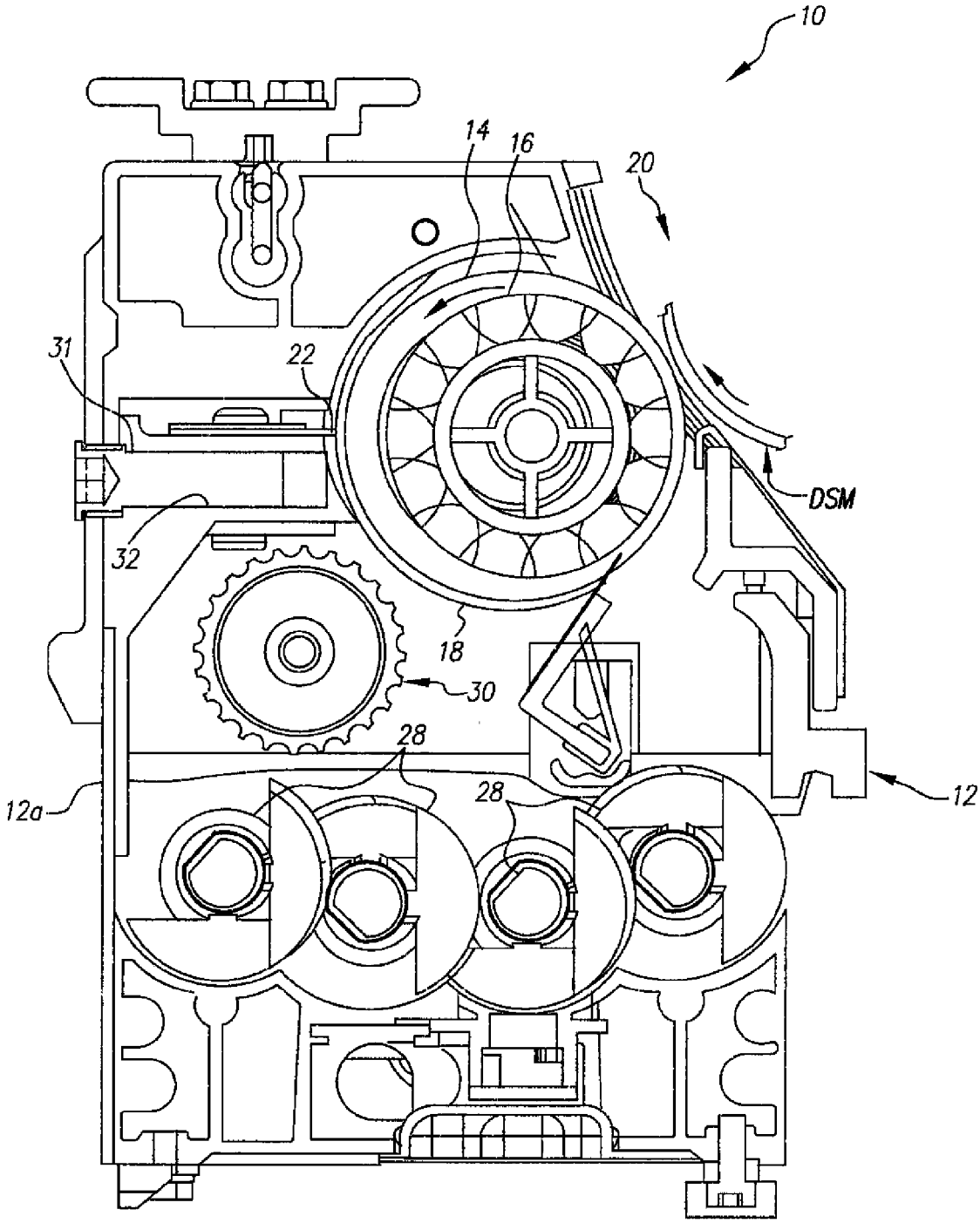
FIG. 1 illustrates a partial cross-sectional end view of one embodiment of a reproduction apparatus magnetic brush development station.

It will be appreciated that for purposes of clarity and where deemed appropriate, reference numerals have been repeated in the figures to indicate corresponding features, and that the various elements in the drawings have not necessarily been drawn to scale in order to better show the features.

DETAILED DESCRIPTION OF THE INVENTION

Referring now to the accompanying drawings, FIG. 1 shows a reproduction apparatus magnetic brush development station, designated generally by the numeral 10. The magnetic brush development station 10 includes a housing 12 forming, in part, a reservoir 12*a* for developer material. The development station housing 12 is locatable in a reproduction apparatus in operative association with a dielectric support member (DSM) adapted to carry latent image charge patterns, and have developer material images formed of such latent image charge patterns, which are thereafter transferred to receiver sheets to form desired reproductions. Since this arrangement forms no part of the instant invention, and is well known in the art, the overall reproduction apparatus is not shown in the accompanying drawings.

As described above, the developer material may be composed of two-part material. As such, a plurality of augers 28 is provided, which have suitable mixing paddles for stirring the developer material within the reservoir 12*a* of the housing 12. A developer roller 14, mounted within the development station housing 12, includes a rotating (counterclockwise in FIG. 1) fourteen-pole core magnet 16 inside a rotating (clockwise in FIG. 1) shell 18. Of course, the core magnet 16 and the shell 18 can have any other suitable relative rotation, which causes developer material to be transported to a development zone 20 into operative association with the dielectric support member DSM to develop latent image charge patterns thereon.

Figure 3:
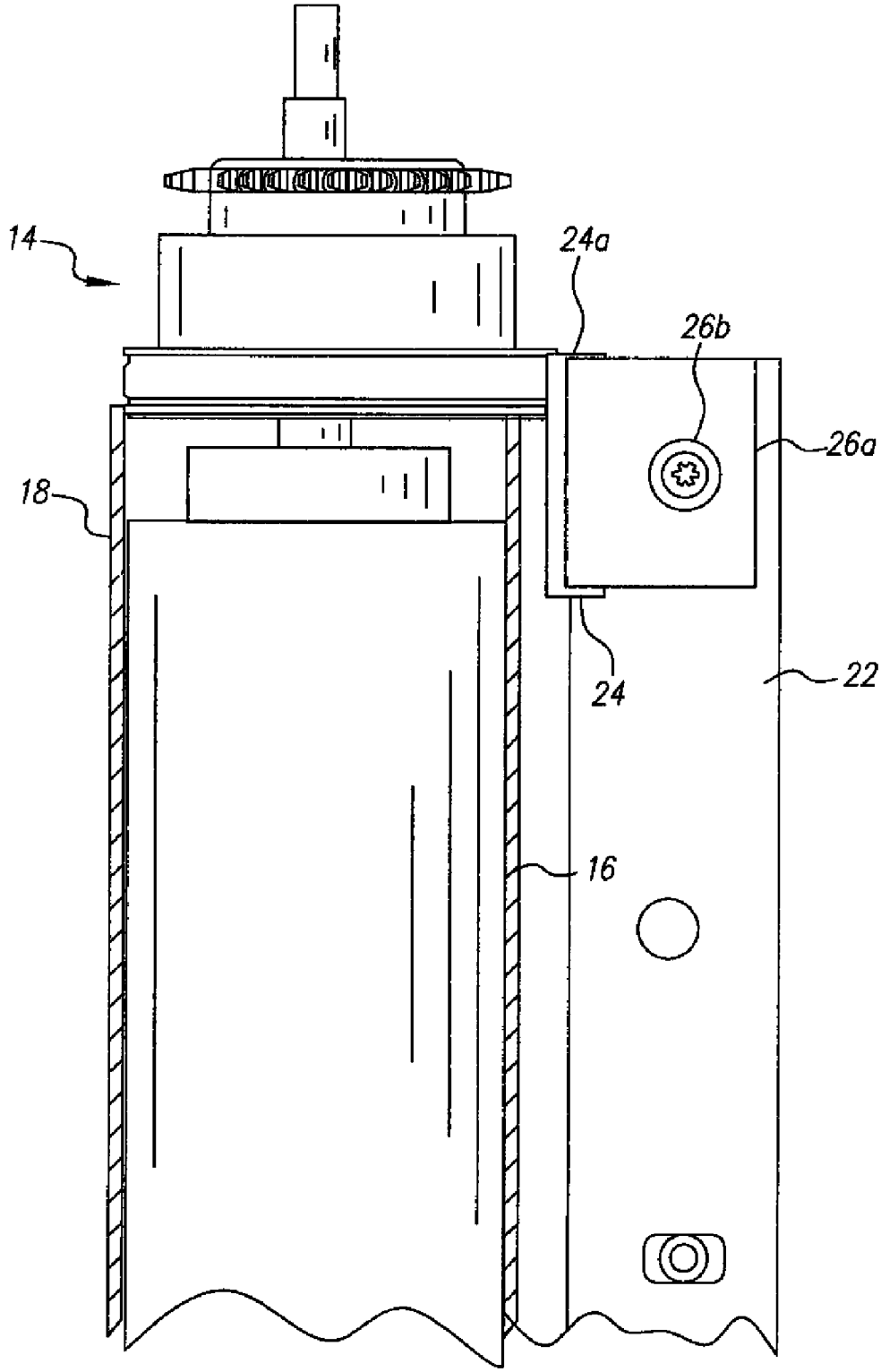
FIG. 3 illustrates a partial cross-sectional enlarged bottom plan view of a portion of the embodied developer roller and metering skive of FIG. 2.
Figure 4:
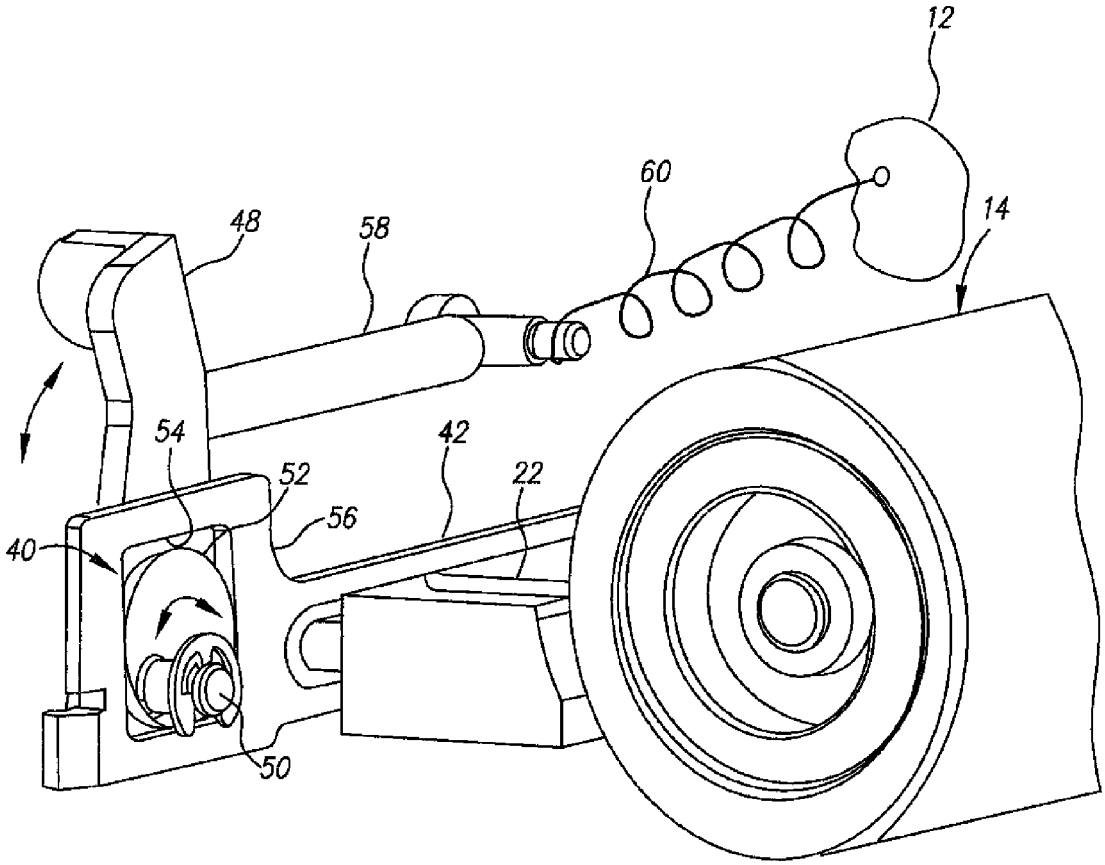
FIG. 4 illustrates a perspective view of the embodied metering skive of FIG. 2, including an embodiment of a cam actuator for selectively moving the metering skive.

The quantity of developer material delivered from the reservoir portion of the housing 12, by a transport roller 30, to the developer roller 14, and then to the development zone 20, is controlled by a metering skive 22. The metering skive 22 is positioned parallel to the longitudinal axis of the developer roller 14, at a location upstream in the direction of shell rotation prior to the development zone 20. The metering skive 22 extends the length of the developer roller 14 (see FIG. 3). The core magnet 16 does not extend the entire length of the developer roller 14. As such, the developer nap on the shell 18 does not extend to the end of the developer roller 14.

Figure 2:
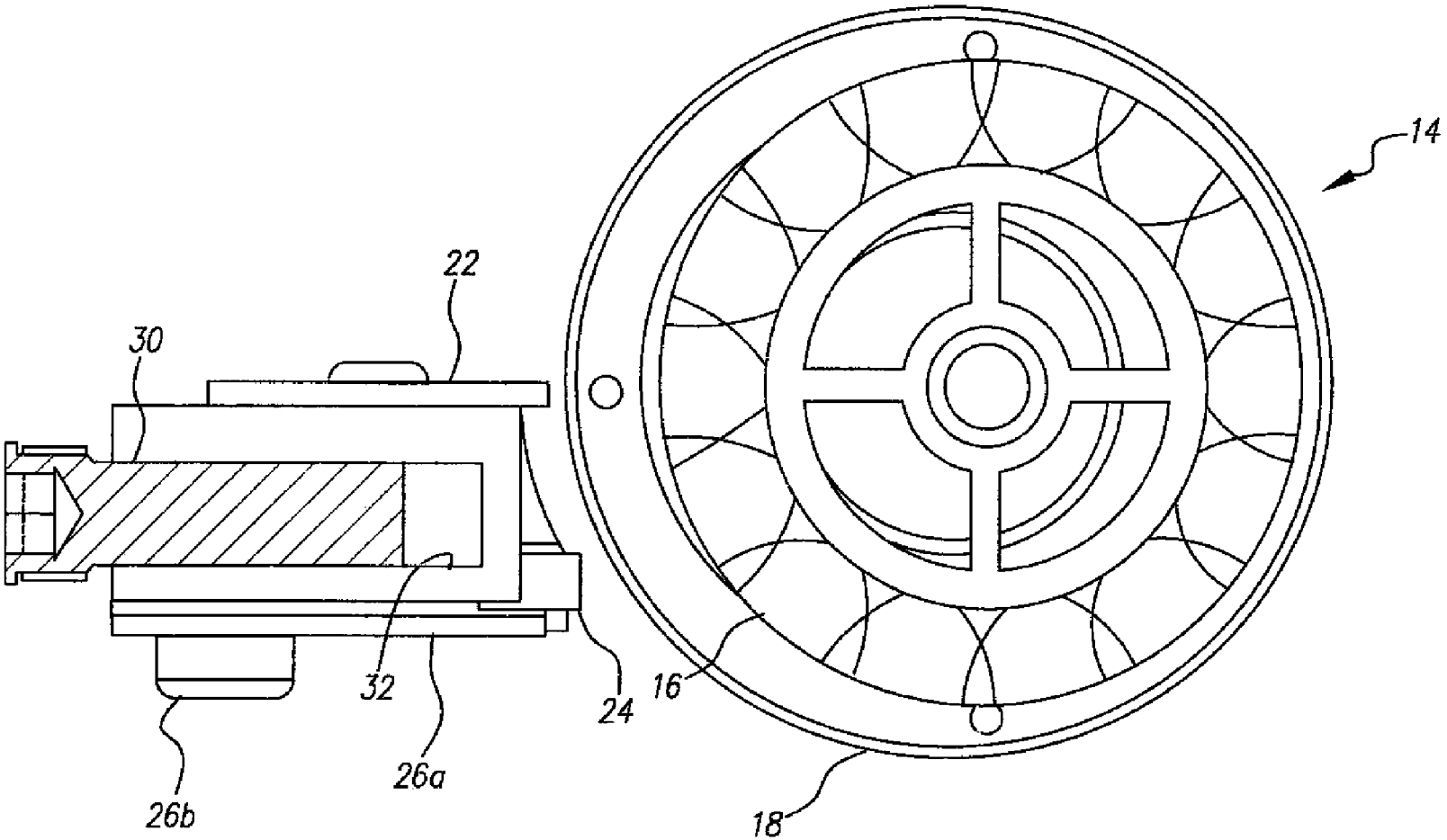
FIG. 2 illustrates a partial cross-sectional enlarged end view of the developer roller and metering skive of the embodied magnetic brush development station of FIG. 1.

At each end of the developer roller 14, a single-pole permanent ceramic magnet 24 is used (one end shown in FIGS. 2 and 3) as a seal to prevent leakage of developer material from the ends of the development roller. The magnet 24 is selected to provide a magnetic field with a strength in the range of 400 to 1200 gauss, and preferably 900 gauss, although other strengths may be used in other embodiments, depending on carrier types, developer roll spacings, operating speeds, etc. One end 24*a* of the magnet 24 is approximately flush with the end of the developer roller 14 and extends along the longitudinal axis of the developer roller such that an overlap (approximately 10 mm) exists with the developer roller. In should be apparent to those skilled in the art that other overlaps may be used, depending on the embodiment. In this embodiment, the single pole magnet 24 is secured to the underside of the metering skive 22 by a metal plate 26*a* and fastener 26*b*, with the active pole of the magnet 24 in close proximity to the developer roller circumference. The metal plate 26*a* functions to shunt the magnetic field, except in the area of the magnet 24, which faces the developer roller 14.

It is apparent that the magnet 24 as described above therefore provides an effective seal preventing developer material from escaping from the ends of the developer roller 14. Since this seal does not have any moving parts, there is no wear, and there is no mechanical friction, which would generate beat and create undesirable developer material flakes. Moreover, there is no seal material, which would wear and contaminate the developer material.

There have been many different attempts at controlling developer nap thickness on the developer roller 14 as a way to decrease sensitivity to developer roller/dielectric support member spacing. If the developer nap is too thick, developer material can leak away from the magnetic core of the developer roller resulting in contamination of other areas of the electrographic reproduction apparatus. If the developer nap is too thin, there may not be enough developer material present in the developer material transported to the development zone 20 to enable high quality image development. Past attempts at controlling the developer nap thickness on the developer roller (like developer roller 14) have included slots in tubes or plates and metering skives. The slot width or developer material skive metering gap (the distance between the metering skive 22 and the developer roller 14), and its relationship to the developer roller, must be tightly controlled if the developer nap is to be adequately and effectively controlled.

Extreme sensitivity of developer nap height to skive metering gap in prior development stations has been well documented. However, placing the skive metering gap in the region of lowest possible magnetic field from the developer roller's magnetic core 16 decreases that sensitivity by a factor of two to four times. This makes the skive-metering gap easier to setup in manufacturing and less sensitive to differences in the skive-metering gap along the length of the developer roller 14. Still, larger particles in the developer material mixture, and other contaminates, can block the developer material flow at the metering gap between the metering skive 22 and the developer roller 14. This may impede flow of the developer material to the developer roller 14, which in turn can cause artifacts in the development of the image to be reproduced. Therefore, in this embodiment, the metering skive 22 is mounted for selective movement to a first position (shown in FIG. 2) in operative association with the developer roller 14 to accurately set a predetermined developer material metering gap, and a second position remote from the first position (shown in FIG. 6).

Figure 5:
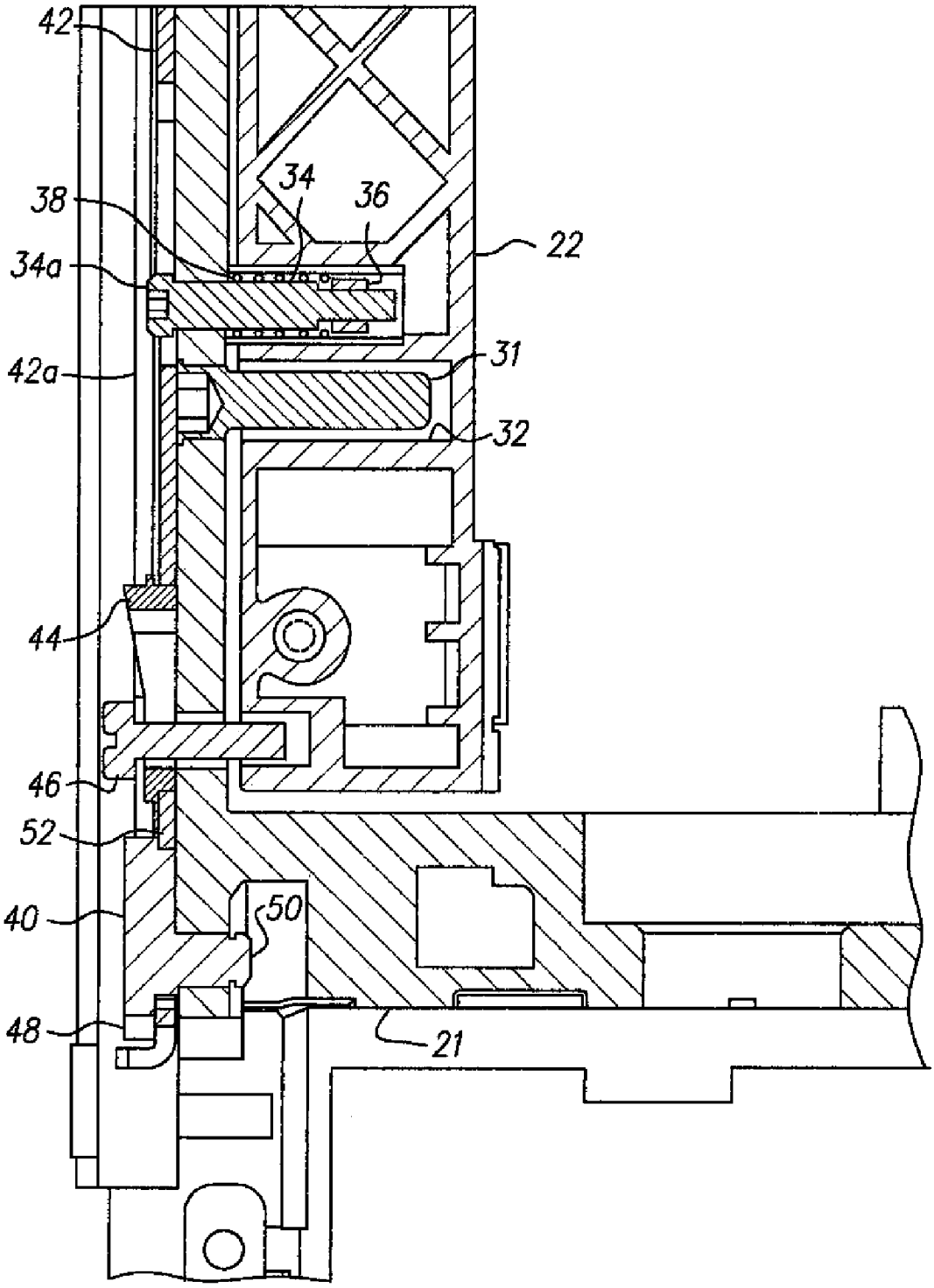
FIG. 5 illustrates a top plan view of the embodied actuator of FIG. 4.

To provide for selective movement of the metering skive 22, as shown in FIG. 5, the metering skive 22 is supported on a member 21, mounted in the development station housing 12, for movement perpendicular to the longitudinal axis of the developer roller 14. The support for the metering skive 22 is provided by a plurality of guide pins 31 (only one is shown in FIG. 5) spaced along the length of the metering skive 22. The guide pins 31 extend from the member 21 and are respectively received within a plurality of bores 32 defined in the metering skive 22 for sliding movement relative thereto. Other embodiments may have different guides or guide pins which allow the metering skive 22 to be moved in an arcuate fashion relative to the developer roller 14.

A plurality of adjusting screws 34 (again, only one is shown in FIG. 5) are threadably received respectively in webs 36 formed in the metering skive 22. The adjusting screws 34 respectively capture springs 38 between the webs 36 and the member 21. The springs 38 urge the adjusting screws 34 threaded into the webs 36 in a direction toward the developer roller 14 until the heads 34*a* of the adjusting screws engage the member 21, thus positioning the metering skive 22 in a desired first operative location relative to the developer roller 14 to accurately set the metering gap at a desired predetermined spacing location for delivery of developer material therethrough. Turning of the adjusting screws 34 serves to respectively change the distance between the webs 36 and the screw heads 34*a* so as to enable the metering gap to be accurately adjusted when necessary to change the predetermined spacing location for setting the metering gap.

An actuator mechanism 40 (best seen in FIG. 5) is provided to selectively move the metering skive 22 to a second position remote from the developer roller 14 so as to enable contaminates to be removed from the metering gap between the metering skive 22 and the developer roller 14. The actuator mechanism 40 includes a slide plate 42 supported on the member 21. A groove 42*a* in the slide plate 42 accommodates the head 34*a* of the adjusting screw 34 and enables the slide plate to move in a direction substantially parallel to the longitudinal axis of the developer roller 14. The slide plate 42 includes a ramp member 44, which moves integrally with the slide plate. The ramp member 44, and slide plate 42 are coupled to the metering skive 22 by a screw 46.

Movement of the slide plate 42, and thus the ramp member 44, is selectively effected by an actuator arm 48. The actuator arm 48 is coupled to a cam member 52 eccentrically mounted on a pin 50. The cam member 52 is received in an opening 54 of a feature 56 extending from the slide plate 42. When the actuator arm 48 is rotated about the axis of the pin 50, the lobe of the cam member 52 engages the walls of the opening 54 and moves the slide plate 42 in the direction parallel to the axis of the developer roller 14. When the slide plate 42 (and ramp member 44) move from the location shown in FIG. 5 in a direction towards the bottom of the page, the ramp member 44 urges the screw 46 in a direction perpendicular to, and away from, the member 21. This in turn moves the metering skive 22 to a second position remote from the aforementioned first position to enable contaminate removal in the manner discussed below. The actuator arm 48 may be moved manually to rotate the cam member 52 about the pin 50, or may be selectively actuated by any suitable electrical or mechanical mechanism such as a motor (not shown). An extension piece 58 is connected to the actuator arm 48 and is urged by a suitable spring member 60 in a direction to position the cam member 52 to set the slide plate 42 such that the metering skive 22 is located in the first (operative) position.

During operation of the development station 12, when images are to be developed to form desired reproductions, the lobe of the cam member 52 is set in a location by urging of the spring member 60 in the position to locate the slide plate 42, and thus the metering skive 22, in the first operative position relative to the developer roller 14. This sets the metering gap between the metering skive 22 and the developer roller 14 at the desired predetermined location such that developer material of ideal thickness will be transported through the metering gap to the development zone 20 to optimally develop desired electrostatic images on the dielectric support member DSM.

During non-operative times, the actuator arm 48 may be selectively rotated by any suitable means (manually or mechanically) to position the cam member 52 to set the lobe of the cam member in the position where the metering skive 22 is moved to the second position remote from the first position. In the second position for the metering skive 22, the metering gap between the metering skive 22 and the developer roller 14 is substantially expanded so as to enable any contaminates, which would otherwise disrupt flow in the metering gap, to flow through such expanded gap. The size (weight) of the contaminate particles CP causes such particles to be jettisoned (see FIG. 6) from the developer material due to centrifugal force and/or lower particle charge. This removes the contaminate particles CP from the developer material such that when operation of the development station 12 is again desired, the actuator arm 48 under the urging of spring member 60 can readily move the metering skive 22 back to the first (operative) position to accurately reset the metering gap between the metering skive 22 and the developer roller 14.

Figure 7:
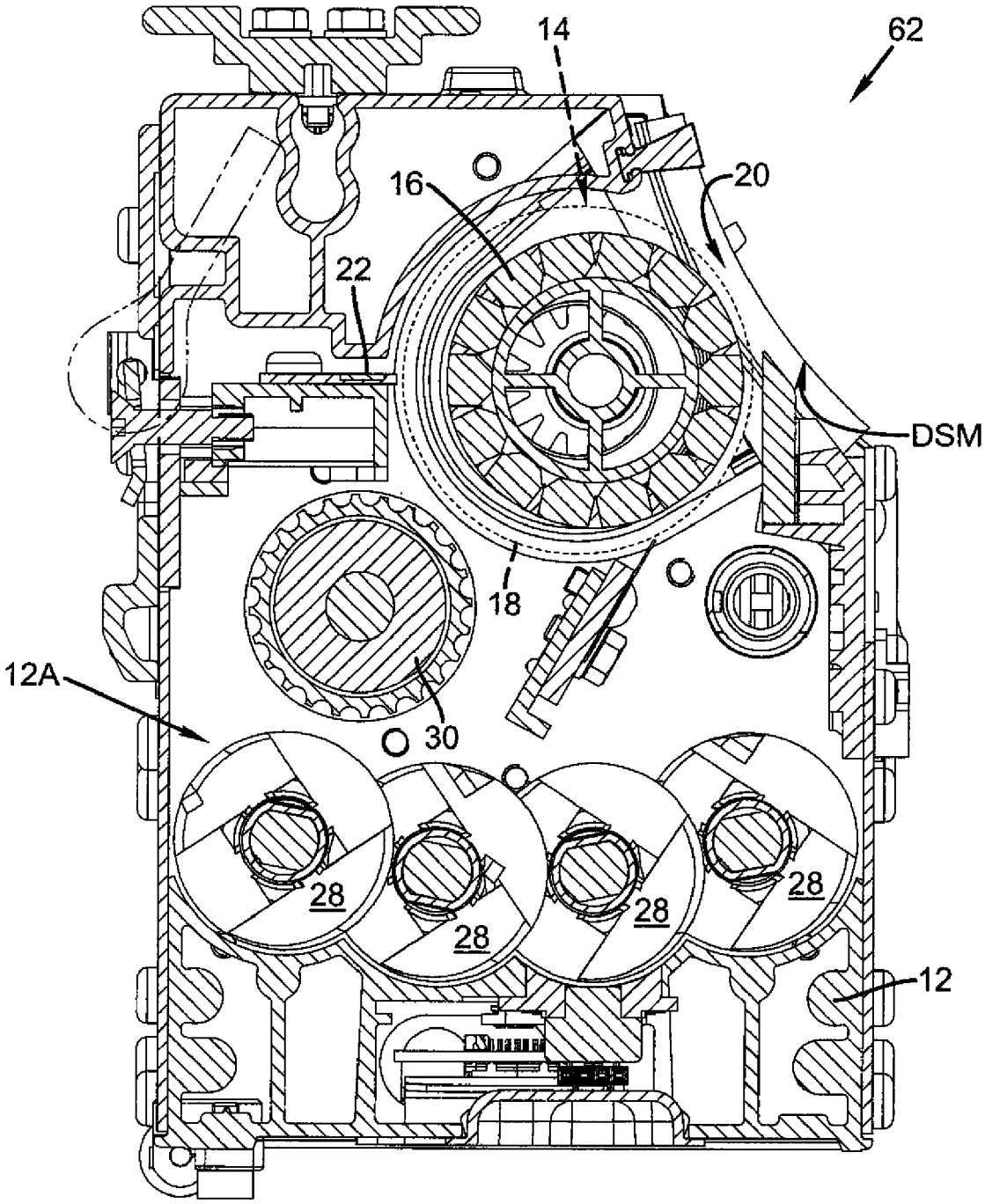
FIG. 7 schematically illustrates a partial cross-sectional end view of another embodiment of a reproduction apparatus magnetic brush development station having another embodiment of a metering skive.

FIG. 7 schematically illustrates a partial cross-sectional end view of another embodiment of a reproduction apparatus magnetic brush development station 62 having another embodiment of a metering skive 22. The magnetic brush development station 62 includes a housing 12 forming, in part, a reservoir 12*a* for developer material. The development station housing 12 is locatable in a reproduction apparatus in operative association with a dielectric support member (DSM) adapted to carry latent image charge patterns, and have developer material images formed of such latent image charge patterns, which are thereafter transferred to receiver sheets to form desired reproductions. Since this arrangement forms no part of the instant invention, and is well known in the art, the overall reproduction apparatus is not shown in the accompanying drawings.

As described above, the developer material may be composed of two-part material. As such, a plurality of augers 28 is provided, which have suitable mixing paddles for stirring the developer material within the reservoir 12*a* of the housing 12. The developer station 62 also has a developer roller 14, a multi-pole core magnet 16, a shell 18, a development zone 20 between the DSM and the developer roller 14, and a transport roller 30, the features of which have been discussed above with regard to FIG. 1. The developer station 62 may also be equipped with a magnetic seal to prevent the leakage of developer material from the ends of the roller as discussed above.

The metering skive 22 helps to control the thickness of a developer material nap on the developer roller 14. Unfortunately, larger particles in the developer material mixture, as well as other contaminates, can block the developer material flow at the metering gap between the metering skive 22 and the developer roller 14. This may impede flow of the developer material to the developer roller 14, which in turn can cause artifacts in the development of the image to be reproduced. Therefore, the metering skive is configured for selective movement from a first position in operative association with the developer roller 14 illustrated in FIG. 7 to a second position remote from the first position (shown in FIG. 10).

Figure 8:
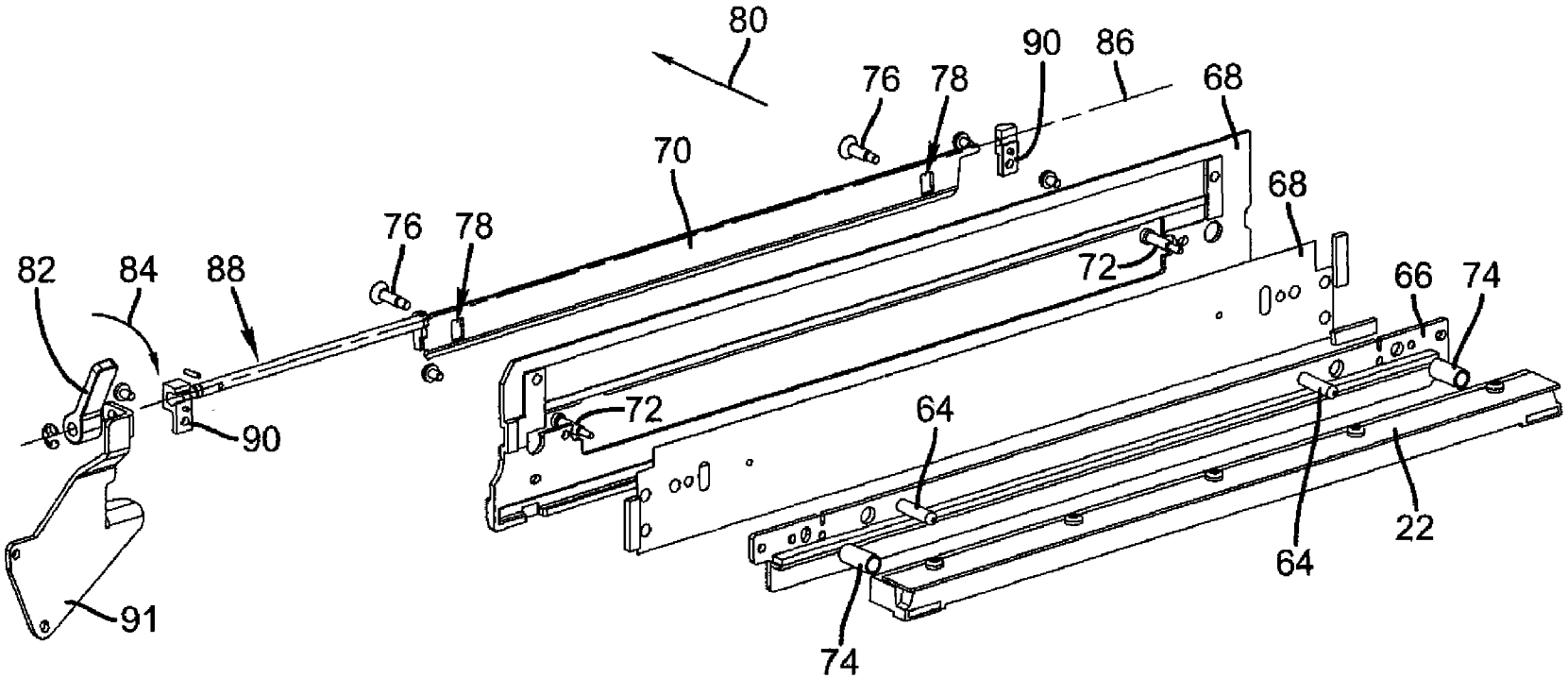
FIG. 8 illustrates a perspective exploded view of the embodied metering skive of FIG. 7 and an embodiment of a mechanism for selectively moving the metering skive from an operative position to a remote position.

FIG. 8 illustrates a perspective exploded view of the embodied metering skive of FIG. 7 and an embodiment of a mechanism for selectively moving the metering skive from an operative position to a remote position. The metering skive 22 has a plurality of bores (not illustrated in this view) which slideably engage a corresponding plurality of guide pins 64 on a side plate 66 adjacent to the metering skive 22. One or more skive frame elements 68 may be positioned between the metering skive 22/side plate 66 combination and a pivot plate 70. The one or more skive frame elements 68 provide support for the side plate 66 and the pivot plate 70. The one or more skive frame elements 68 may be separate from but configured to be coupled to the developer station housing. In other embodiments, the one or more skive frame elements 68 may be integral with the developer station housing.

Adjustment screws 72 pass through the skive frame element 68, the side plate 66, and a spring element 74 and into the metering skive 22. The spring elements 74 are configured to bias the metering skive 22 away from the side plate 66. Suitable examples of spring elements which may be used include, but are not limited to a leaf spring, a coil spring, and an elastomer grommet. By tightening the adjustment screws 74, the metering skive 22 may be positioned closer to the side plate 66 (farther from the developer roll which is not shown in this view) in an operating position. By loosening the adjustment screws 74, the metering skive 22 may be positioned farther from the side plate 66 (closer to the developer roll which is not shown in this view) in the operating position.

Activation screws 76 pass through slots 78 defined by the pivot plate 70, past the skive frame elements 68, through the side plate 66, and into the metering skive 22. Preferably, the activation screws 76 are not adjusted so tightly that the metering skive 22 is not allowed to travel away from the side plate 66 as far as the adjustment screws 72 are set for. Instead, the activation screws 76 are coupled to the metering skive 22 such that if the activation screws 76 are moved in a direction 80 substantially opposite the metering skive 22, the metering skive will be drawn back towards the side plate 66 when the moving force applied to the activation screws 76 overcomes the opposing force of the spring elements 74. Such a moving force may be supplied by pivoting an actuator such as skive handle 82 in a clockwise direction 84 (other embodiments may use other directions) to rotate the pivot plate 78 coupled to the skive handle 82. Upon rotation 84, the pivot plate 70 pivots on a rotation axis 86, causing the pivot plate slots 78 to engage the activation screws 76 and move them in a backward direction 80. This draws the metering skive 22 against the spring elements 74. When the skive handle 82 is released, the spring elements 74 return the metering skive 22 to its original position. In this embodiment, the skive handle 82 is coupled to the pivot plate 70 via a pivot axle 88 in order to improve the reachability of the skive handle 82. In other embodiments, the skive handle 82 may be directly coupled to the pivot plate 70. The portions of the pivot plate 70 and/or pivot axle 88 which define the rotation axis 86 may be coupled to the skive frame element 68 by pivot guides 90. Additional support brackets 91 may be added as desired.

Figure 9A:
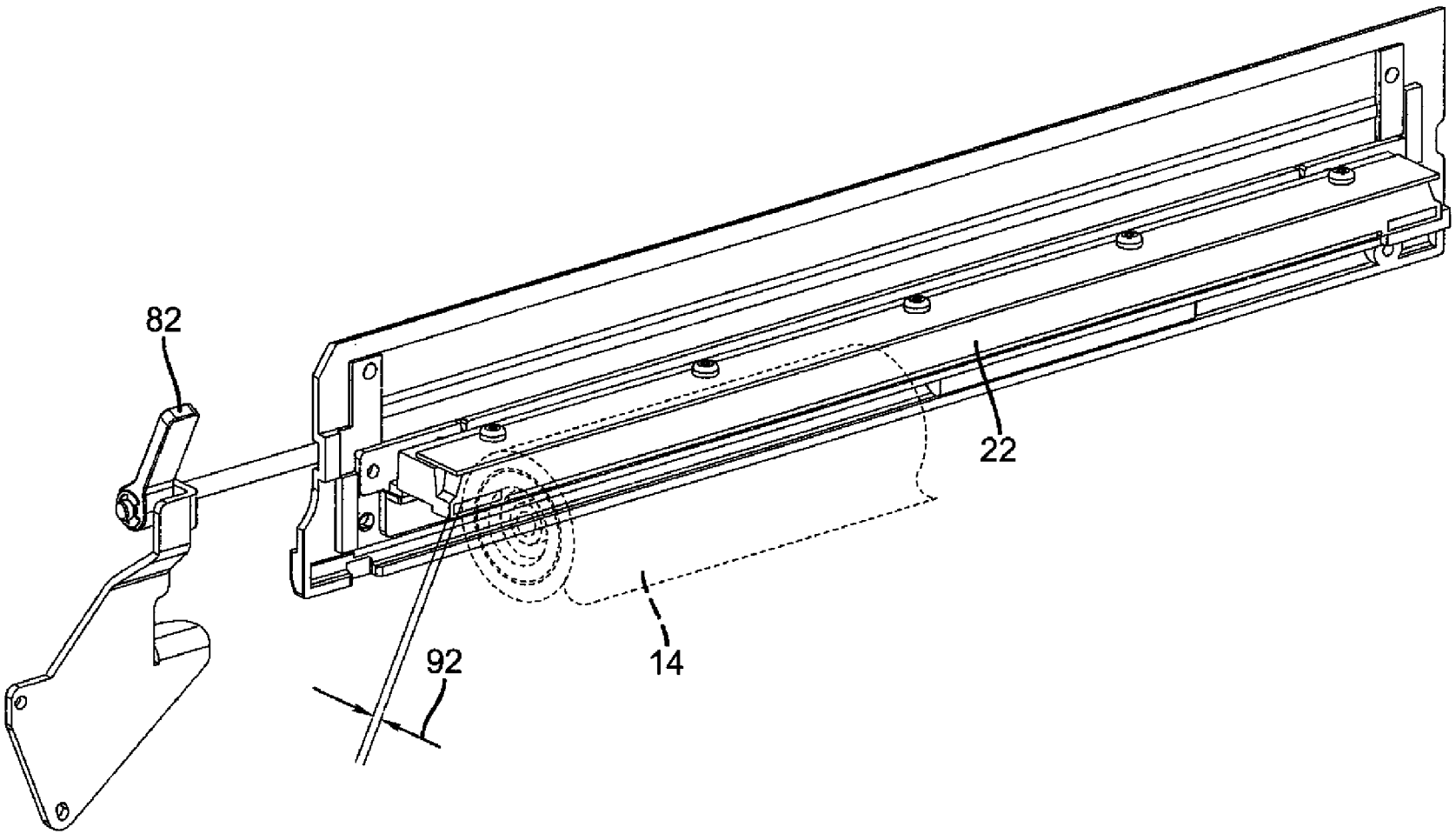
FIG. 9A schematically illustrates a perspective view of the embodied metering skive of FIG. 7 in an operative position relative to a developer roller.

FIG. 9A schematically illustrates a perspective view of the embodied metering skive 22 of FIG. 7 in an operative position relative to a developer roller 14. In the operative position (since no force is being applied to the skive handle 82), a nominal skive-to-developer-roller gap 92 is maintained to control developer nap height.

Figure 9B:
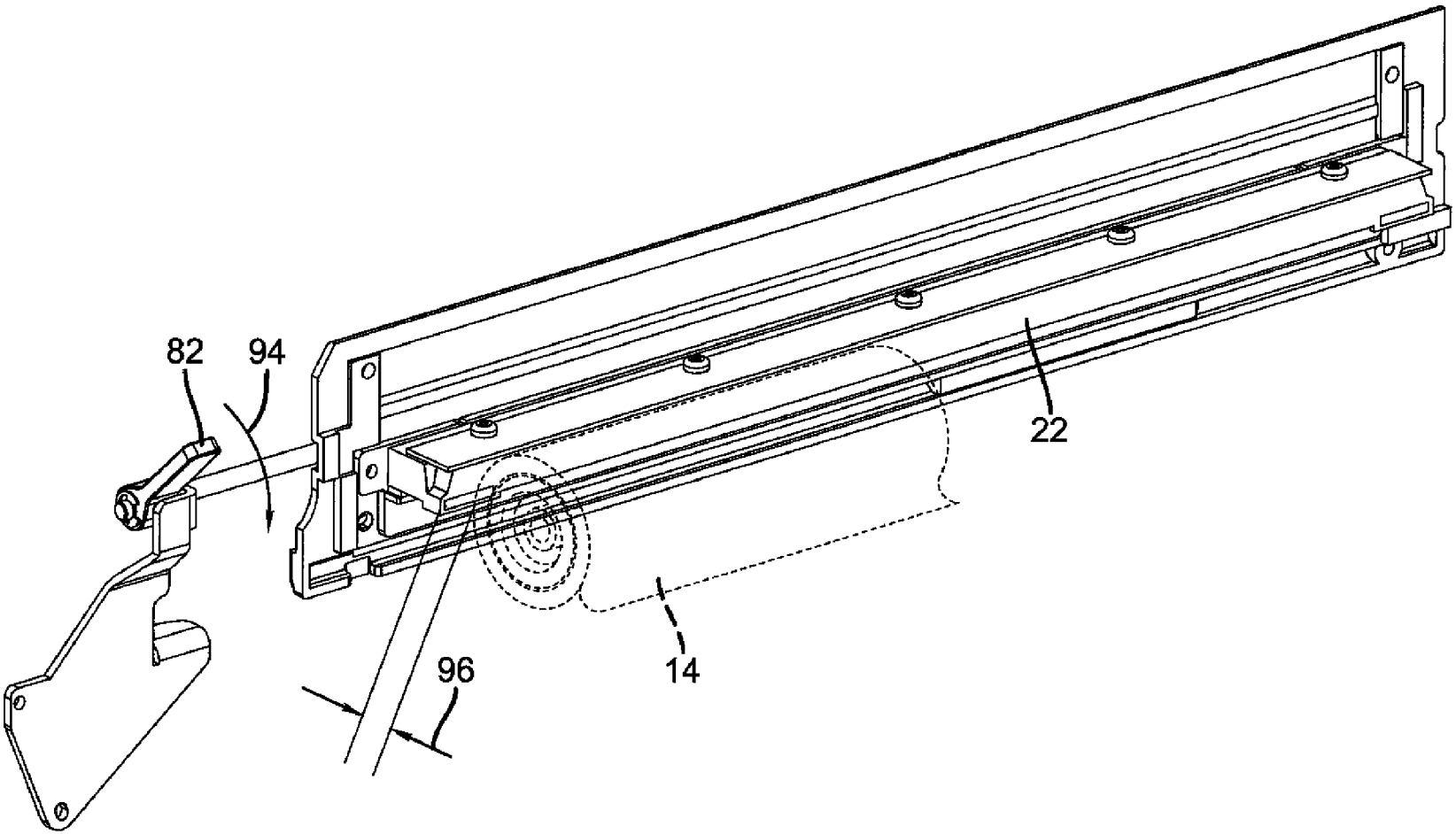
FIG. 9B schematically illustrates a perspective view of the embodied metering skive of FIG. 7 in a remote position.

FIG. 9B schematically illustrates a perspective view of the embodied metering skive 22 of FIG. 7 in a remote position relative to the developer roller 14. In the remote position (as a result of the pivoting movement 94 of the skive handle 82), an enlarged skive-to-developer-roll gap 96 is created.

Figure 10:
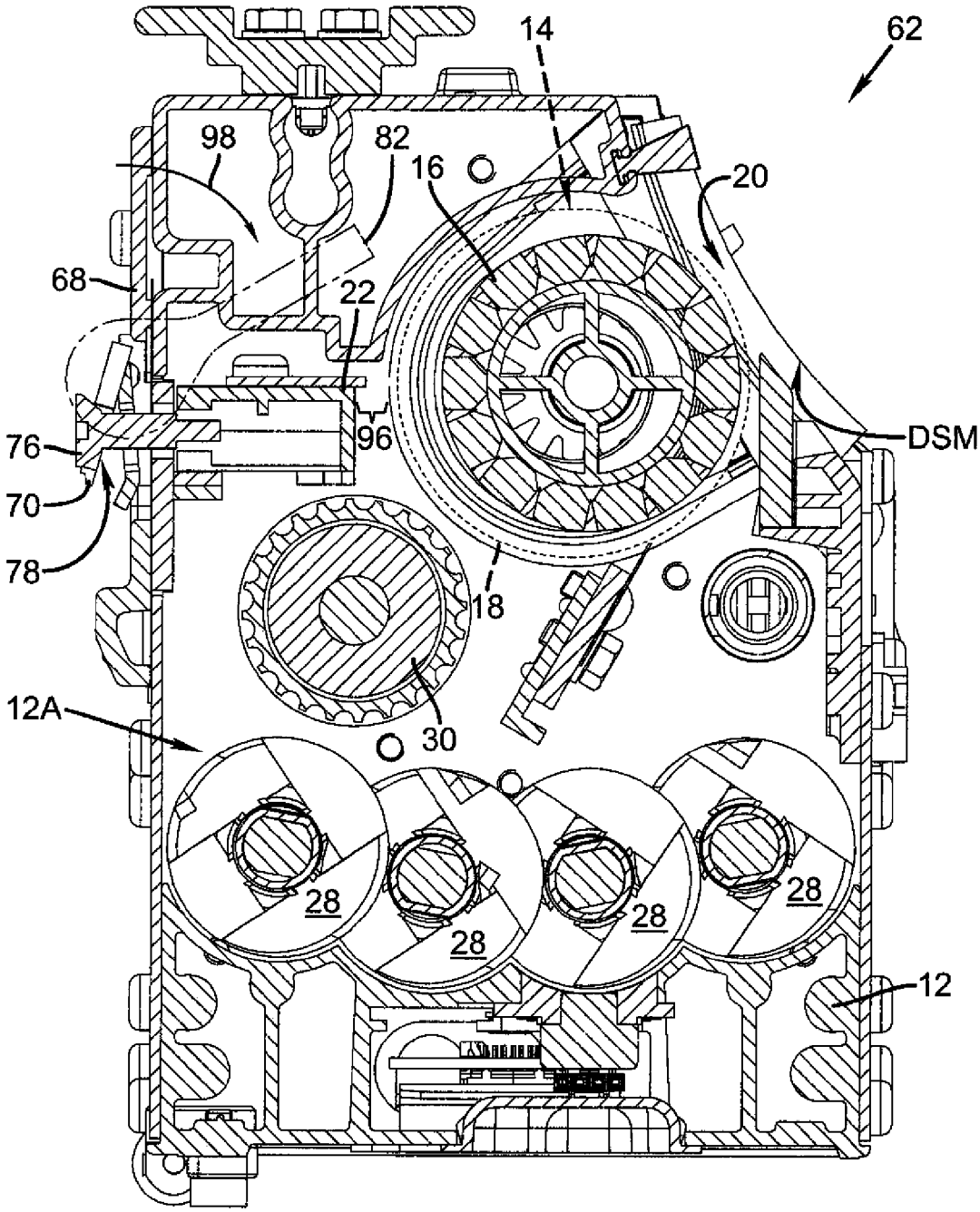
FIG. 10 schematically illustrates a partial cross-sectional end view of the embodied reproduction apparatus magnetic brush development station of FIG. 7 wherein the metering skive has been moved to a remote position.

FIG. 10 schematically illustrates a partial cross-sectional end view of the embodied reproduction apparatus magnetic brush development station 62 of FIG. 7 wherein the metering skive 22 has been moved to a remote position. The skive handle 82 has been rotated 98, thereby causing the pivot plate 70 to pivot out away from the skive frame elements 68. The slot 78 defined by the pivot plate 70 pulls leftward (as viewed in FIG. 10) on the activation screw 76. Since the activation screw 76 is coupled to the metering skive 22, the metering skive 22 is drawn away from the developer roller 14 creating an enlarged gap 96.

Figure 6:
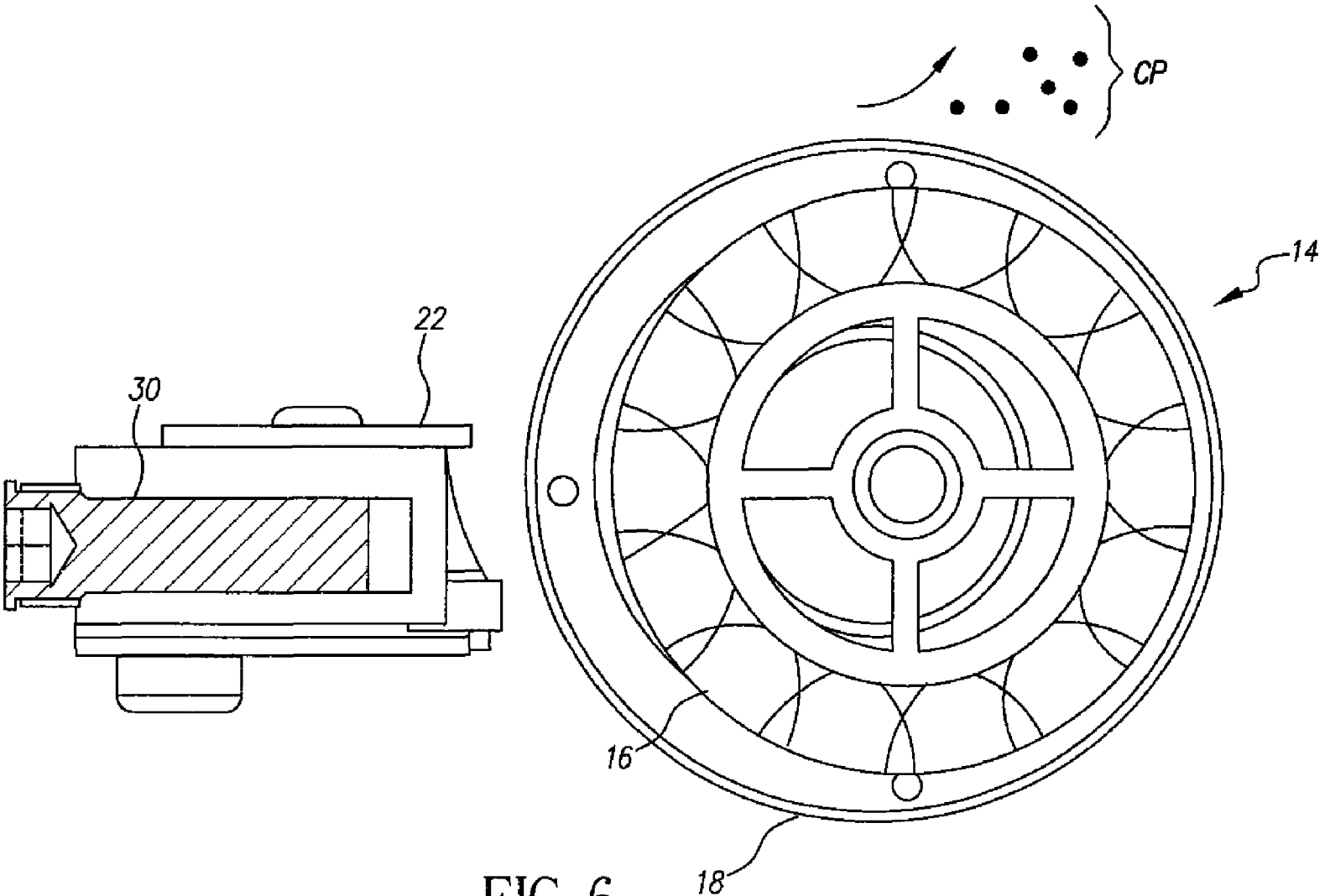
FIG. 6 illustrates a partial cross-sectional enlarged end view of the embodied developer roller and metering skive of the embodied magnetic brush development station of FIG. 1 showing the action on contaminates when the metering skive is moved to a remote position.

Similar to the operation of the mechanism of FIGS. 1 and 6, the skive handle 82 of the embodiment of FIGS. 7-10 may be actuated by hand or by a suitable electromechanical actuation mechanism such as, but not limited to, a solenoid. As before, the actuation may be done while the developer roller 14 is operated, thereby allowing large particulate debris which may have been clogging the metering skive to be flung free of the developer station by centrifugal force while the metering skive is in the remote position.

Although the trend in printing systems is typically advancing towards the automation of machine maintenance, it has been discovered that the above embodiments of metering skives and associated skive movement mechanisms may optionally and advantageously be used in conjunction with a thumbwheel for manually spinning the development roller.

Figure 11:
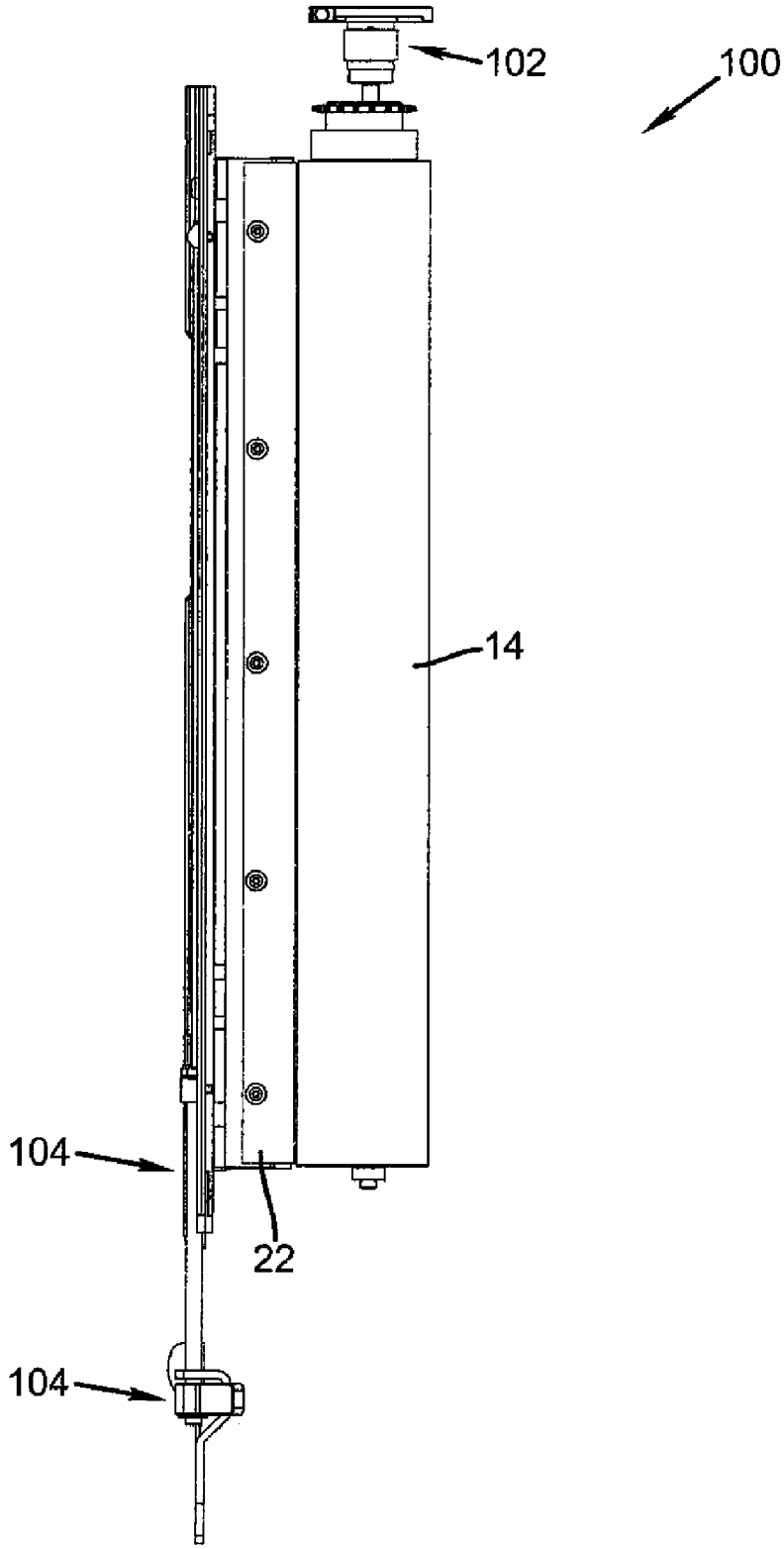
FIG. 11 schematically illustrates a top view of a portion of a further embodiment of a reproduction apparatus magnetic brush development station having an embodiment of a thumbwheel.

FIG. 11 schematically illustrates a top view of a portion of a further embodiment of a reproduction apparatus magnetic brush development station 100 having an embodiment of a thumbwheel 102. The thumbwheel 102 may be rotated by hand as an alternative to the drive system which powers the developer roller 14 during a printing or automated service operation. The developer station 100 also has a metering skive 22 and a mechanism 104 for selectively moving the metering skive from an operative position (illustrated) to a removed position away from the developer roller 14. Although the mechanism 104 illustrated in FIG. 11 is similar to the embodiment of FIGS. 7-10, it should be understood that the mechanism 104 could be implemented with other configurations, such as the embodiment of FIGS. 1-6.

Figure 12:
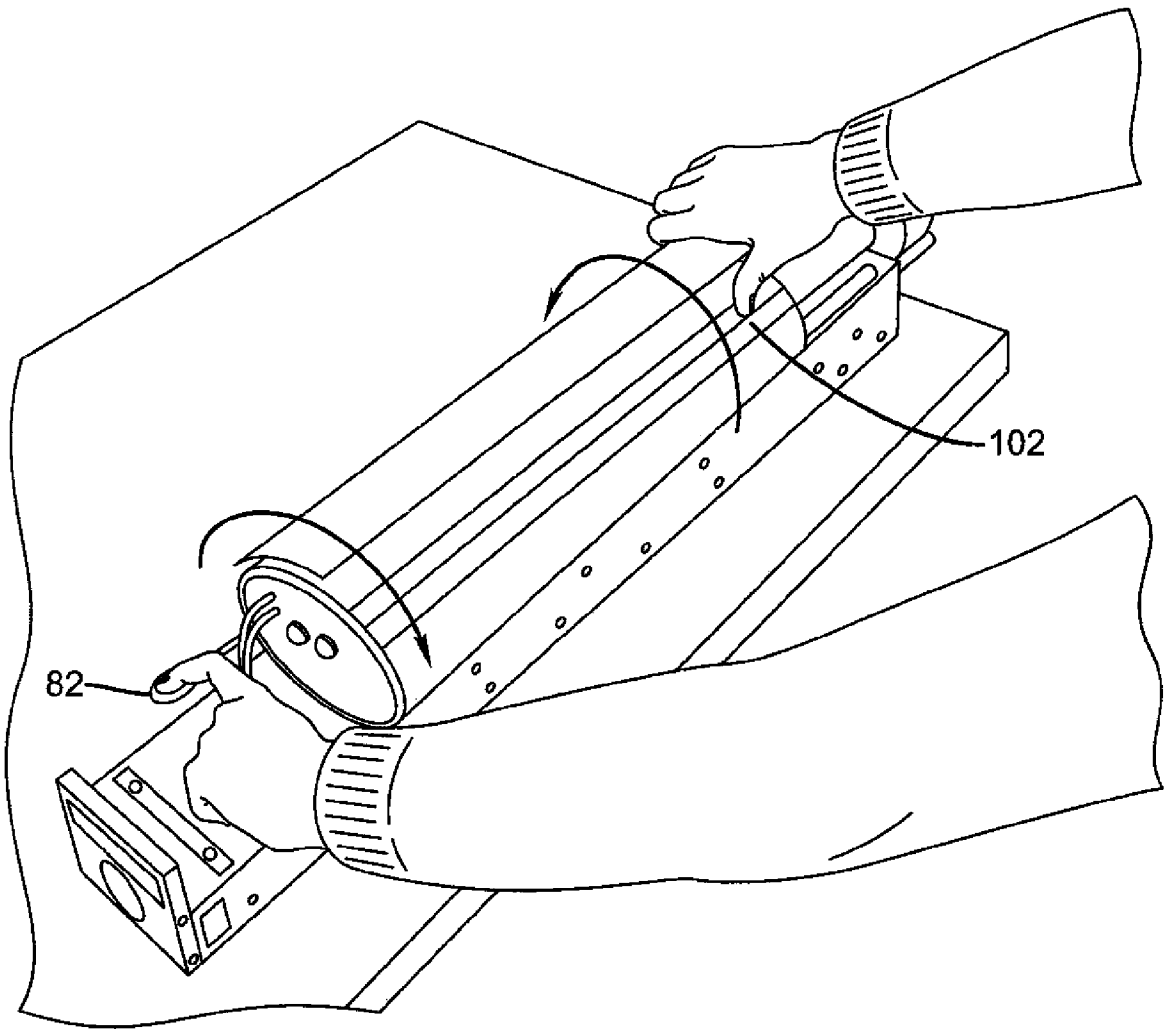
FIG. 12 illustrates an operator manipulating the embodied thumbwheel and mechanism for moving the metering skive for the embodied development station of FIG. 11.

FIG. 12 illustrates an operator manipulating the embodied thumbwheel 102 and the handle 82 of the mechanism for moving the metering skive for the embodied development station of FIG. 11.

Figure 13:
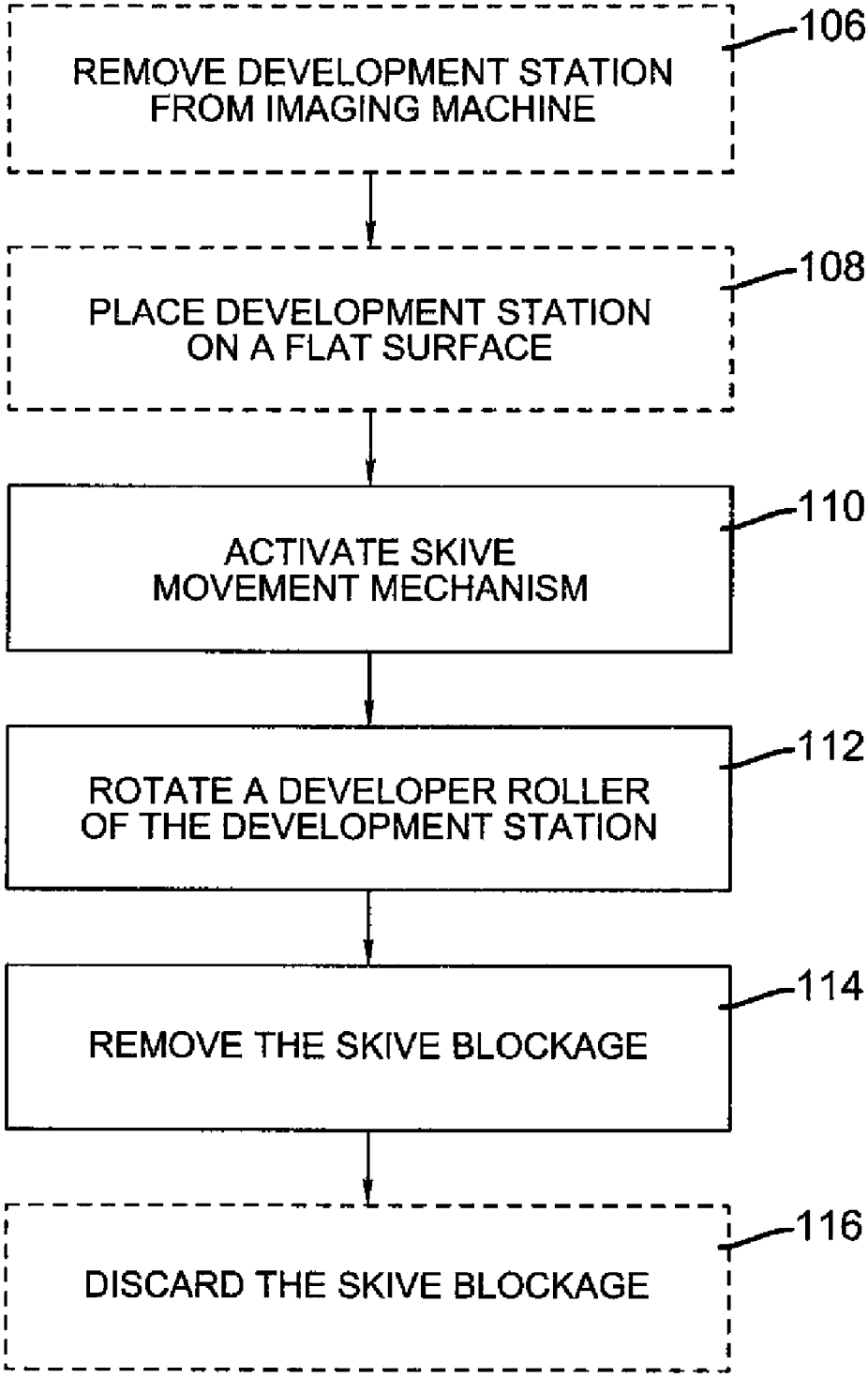
FIG. 13 illustrates one embodiment of a method of removing a blockage from a metering skive.

FIG. 13 illustrates one embodiment of a method of removing a blockage from a metering skive, for example by using a development station such as the embodiment of FIG. 11 in a manner similar to that illustrated by FIG. 12. The development station may optionally be removed 106 from its imaging machine. Removal of the development station may make it easier to reach the thumbwheel and the actuator for the skive movement mechanism at the same time. Removing the development station may also allow the covers of the imaging machine to be closed which can reduce the likelihood that the photoconductor of the print engine will develop a latent image memory issue from long-term exposure to ambient light. The development station may optionally be placed 108 on a flat surface. The flat surface can help balance and stabilize the development station. The skive movement mechanism is activated 110 and a developer roller of the development station is rotated 112. A powered drive system such as, but not limited to, gears and/or a motor may be used to rotate the developer roller. Optionally, the developer roller may be rotated by rotating a development station thumbwheel until a skive blockage appears on the toning shell of the developer roller. The blockage is then removed 114 and optionally discarded 116. In some embodiments, the skive blockage removal may be accomplished through centrifugal force generated by the rotating developer roller (either by manual or driven rotation). In other embodiments, the skive blockage removal may be done manually. By manually performing the skive blockage removal, the blockages are more likely to be removed completely from the development station, rather than just knocked back into the developer reservoir. Furthermore, since the operation may be completed external to the imaging machine, the risk of contamination of the imaging machine with flying developer and/or block particles during a servicing is greatly reduced. It should also be noted that, depending on the embodiment, the skive movement mechanism should be activated 110 for at least a portion of the time that the developer roller is rotated 112, preferably for the entire time that the developer roller is rotated, and optionally also before and/or after the developer roller is rotated. In other embodiments, the activation 110 of the skive movement mechanism may temporarily lock the skive movement mechanism in a remote position so that the activation action 110 does not have to be maintained during the rotation 112 of the developer roller. In this type of embodiment, the activation 110 can occur before or after the rotation 112 of the developer roller begins.

The advantages of a moveable metering skive for a development station of a reproduction apparatus have been discussed herein. Embodiments discussed have been described by way of example in this specification. It will be apparent to those skilled in the art that the foregoing detailed disclosure is intended to be presented by way of example only, and is not limiting. For example, in some embodiments, the metering skive itself could be the mechanism for selectively moving the metering skive to a position remote from the developer roller. In such an embodiment, a user could manually, or through a controllable actuation mechanism, apply force directly to the metering skive to move it to the remote position. Various other alterations, improvements, and modifications will occur and are intended to those skilled in the art, though not expressly stated herein. These alterations, improvements, and modifications are intended to be suggested hereby, and are within the spirit and the scope of the claimed invention. Additionally, the recited order of processing elements or sequences, or the use of numbers, letters, or other designations therefore, is not intended to limit the claims to any order, except as may be specified in the claims. Accordingly, the invention is limited only by the following claims and equivalents thereto.

PARTS LIST

10 Magnetic brush development station
12 Housing
**12*a*** Reservoir
14 Developer roller
16 Core magnet
18 Shell
20 Development zone
21 Member
22 Metering skive
24 Single pole magnet
**24*a*** End
**26*a*** Metal plate
**26*b*** Fastener
28 Augers
30 Transport roller
31 Guide pins
32 Bores
34 Adjusting screws
**34*a*** Screw heads
36 Webs
38 Capture springs

40 Actuator mechanism
42 Slide plate
42*a* Groove
44 Ramp member
46 Screw
48 Actuator arm
50 Pin
52 Cam member
54 Opening
56 Feature
58 Extension piece
60 Spring member
62 Magnetic brush development station
64 Guide pin
66 Side plate
68 Skive frame element
70 Pivot plate
72 Adjustment screw
74 Spring element
76 Activation screw
78 Slot defined by the pivot plate
82 Skive handle
88 Pivot axle
90 Pivot guide
91 Support bracket
92 Operating gap between metering skive and developer roll
96 Expanded gap between metering skive and developer roll
100 Magnetic brush development station
102 Thumbwheel
104 Mechanism for selectively moving the metering skive from an operative position to a retracted position

What is claimed is:

1. A magnetic brush development station for a reproduction apparatus, said magnetic brush development station comprising:

a housing forming, at least in part, a reservoir for developer material;

a developer roller mounted within the housing for delivering developer material to a reproduction apparatus dielectric support member in a development zone, the developer roller including a core magnet inside a shell, the core magnet and the shell having relative rotation;

a transport mechanism for transporting developer material from the reservoir to the developer roller;

a metering skive for establishing a developer material metering gap between the metering skive and the developer roller for controlling the quantity of developer material transported from the reservoir portion of the housing to the developer roller and then through the development zone to develop a latent image charge pattern on the dielectric support member; and a mechanism for selectively moving the metering skive to an operative position relative to the developer roller and to a position remote from the developer roller, wherein a build up of contamination collected at the metering gap between the metering skive and the developer roller when the metering skive is at the operative position can pass through the gap.

2. The magnetic brush development station of claim 1 wherein the metering skive is positioned parallel to the longitudinal axis of the developer roller at a location upstream in the direction of rotation prior to the development zone.

3. The magnetic brush development station of claim 1 wherein the mechanism for selectively moving the metering skive comprises a side plate slideably coupled to the metering skive.

4. The magnetic brush development station of claim 3, wherein the side plate comprises one or more guide pins which slideably engage corresponding one or more bores defined by the metering skive.

5. The magnetic brush development station of claim 4, further comprising:

one or more spring elements positioned to bias the metering skive away from the side plate; and one or more adjustment screws configured to limit a slideable range of motion of the metering skive away from the side plate.

6. The magnetic brush development station of claim 5, further comprising:

a pivot plate defining at least one slot;

at least one skive frame element coupled to the housing and configured to pivotally support the pivot plate; and at least one activation screw coupled to the metering skive through the at least one slot.

7. The magnetic brush development station of claim 6, further comprising at least one pivot guide coupled to the at least one skive frame element to support the pivot plate.

8. The magnetic brush development station of claim 6, wherein the pivot plate further comprises a pivot axle.

9. The magnetic brush development station of claim 6, further comprising an actuator coupled to the pivot plate for rotating the pivot plate about a pivot axis.

10. The magnetic brush development station of claim 9, wherein the actuator is selected from the group consisting of a skive handle, a lever, a wheel, and a solenoid.

11. The magnetic brush development station of claim 1, further comprising a thumbwheel coupled to the developer roll and configured to enable manual rotation of the developer roll.

12. The magnetic brush development station of claim 1, wherein the contaminants include large particles that cannot pass through the metering gap when the skive is in the operative position and wherein the size of the expanded gap created when the the metering skive is moved remote position is sufficient to allow the large particles to pass through the gap.

13. A magnetic brush development station for a reproduction apparatus, said magnetic brush development station comprising:

a) a housing forming, at least in part, a reservoir for developer material;

b) a developer roller mounted within the housing for delivering developer material to a reproduction apparatus dielectric support member in a development zone, the developer roller including a core magnet inside a shell, the core magnet and the shell having relative rotation;

c) a transport mechanism for transporting developer material from the reservoir to the developer roller;

d) a metering skive for establishing a developer material metering gap between the metering skive and the developer roller for controlling the quantity of developer material transported from the reservoir portion of the housing to the developer roller and then through the development zone to develop a latent image charge pattern on the dielectric support member;

e) a mechanism for selectively moving the metering skive to an operative position relative to the developer roller and to a position remote from the developer roller, wherein a build up of contamination at the metering gap between the metering skive and the developer roller can be substantially prevented;

f) wherein the mechanism for selectively moving the metering skive comprises a side plate slideably coupled to the metering skive;

g) wherein the side plate comprises one or more guide pins which slideably engage corresponding one or more bores defined by the metering skive;

h) one or more spring elements positioned to bias the metering skive away from the side plate;

i) one or more adjustment screws configured to limit a slideable range of motion of the metering skive away from the side plate;

j) a pivot plate defining at least one slot;

k) at least one skive frame element coupled to the housing and configured to pivotally support the pivot plate;

l) at least one activation screw coupled to the metering skive through the at least one slot;

m) at least one pivot guide coupled to the at least one skive frame element to support the pivot plate;

n) wherein the pivot plate further comprises a pivot axle;

o) an actuator coupled to the pivot plate for rotating the pivot plate about a pivot axis; and p) a thumbwheel coupled to the developer roll and configured to enable manual rotation of the developer roll.

* * * * *